US005419789A

United States Patent [19]

Kita

[11] Patent Number: 5,419,789

[45] Date of Patent: May 30, 1995

[54] ALUMINUM-BASED ALLOY WITH HIGH STRENGTH AND HEAT RESISTANCE CONTAINING QUASICRYSTALS

[75] Inventor: Kazuhiko Kita, Uozu, Japan

[73] Assignee: YKK Corporation, Tokyo, Japan

[21] Appl. No.: 115,703

[22] Filed: Sep. 3, 1993

[30] Foreign Application Priority Data

Sep. 11, 1992 [JP] Japan ..... 4-243253

[51] Int. Cl.[6] ..... C22C 1/04; C22C 21/00

[52] U.S. Cl. ..... 148/437; 148/403; 420/550; 420/551

[58] Field of Search ..... C22C 21/00; 420/550, 420/551, 528–549; 148/690, 415, 698, 403, 437

[56] References Cited

U.S. PATENT DOCUMENTS

| | | | |
|---|---|---|---|
| 3,925,071 | 12/1975 | Ghosh | 75/170 |
| 4,347,076 | 8/1982 | Ray et al. | 420/551 |
| 4,832,737 | 5/1989 | Mathy et al. | 75/249 |
| 5,053,085 | 10/1991 | Masumoto et al. | 148/403 |
| 5,204,191 | 4/1993 | DuBois et al. | 428/650 |

FOREIGN PATENT DOCUMENTS

| | | |
|---|---|---|
| 0219629 | 4/1987 | . |
| 0339676 | 11/1989 | European Pat. Off. . |
| 0445684 | 9/1991 | European Pat. Off. . |
| 0457101 | 3/1992 | European Pat. Off. . |
| 0529542 | 3/1993 | European Pat. Off. . |

OTHER PUBLICATIONS

Tsai, et al., "New Decagonal Al-Ni-Fe and Al-Ni-Co Alloys Prepared by Liquid Quenching," Materials Transactions, J. I. M., vol. 30, No. 2 1989, pp. 150–154.

Nelson, David R., "Quasicrystals", *Scientific American*, Aug. 1986, pp. 43–51.

*Primary Examiner*—George Wyszomierski

*Assistant Examiner*—Sean Vincent

*Attorney, Agent, or Firm*—Finnegan, Henderson, Farabow, Garrett & Dunner

[57] ABSTRACT

An aluminum-based alloy which consists Al and 0.1 to 25 atomic % of at least two transition metal elements and has a structure in which at least quasicrystals are homogeneously dispersed in a matrix composed of Al or a supersaturated Al solid solution. The quasicrystals are preferably composed of an I-phase alone or a mixed phase of an I-phase and a D-phase and preferably has a volume nfraction of 20% or less. Specifically, the aluminum-based alloy has the composition represented by the general formula $Al_{bal}Ni_aX_b$ or $Al_{bal}Ni_aX_bM_c$ wherein X is one or two elements selected between Fe and Co; M is at least one element selected from among Cr, Mn, Nb, Mo, Ta and W; $5 \leqq a \leqq 10$; $0.5 \leqq b \leqq 10$; and $0.1 \leqq c \leqq 5$. The alloy is excellent in hardness and strength both at room temperature and high temperature and in heat resistance and has a high specific strength. It can retain the excellent characteristics even when affected by the heat of working.

17 Claims, 2 Drawing Sheets

ALUMINUM-BASED ALLOY WITH HIGH STRENGTH AND HEAT RESISTANCE CONTAINING QUASICRYSTALS

BACKGROUND OF THE INVENTION

1. Field of the Invention

The present invention relates to an aluminum-based alloy having superior properties of high strength, high hardness and high heat resistance which comprises at least quasicrystals finely dispersed in a matrix composed of a principal metal element (aluminum).

2. Description of the Prior Art

An aluminum-based alloy having high strength and high heat resistance has heretofore been produced by the rapid solidifying methods such as liquid quenching method. In particular, the aluminum-based alloy produced by the rapid solidifying method as disclosed in Japanese Patent Laid-Open No. 275732/1989 is amorphous or microcrystalline, and particularly the microcrystal as disclosed therein comprises a composite material that is constituted of a metallic solid solution composed of an aluminum matrix, a microcrystalline aluminum matrix phase and a stable or metastable intermetallic compound phase.

The aluminum-based alloy disclosed in the Japanese Patent Laid-Open No. 275732/1989 is an excellent alloy exhibiting high strength, high heat resistance and high corrosion resistance and further favorable workability as a high strength structural material but is deprived of tile excellent characteristics as the rapidly solidified material in a temperature region as high as 300° C. or above, thereby leaving some room for further improvement with respect to heat resistance, especially heat-resisting strength.

Moreover, there is some room also for improvement with regard to specific strength of the alloy, since the alloy is not sufficiently enhanced in specific strength because of its being incorporated with an element having a relatively high specific gravity.

SUMMARY OF THE INVENTION

It is an object of the present invention to provide an aluminum-based alloy having superior heat resistance, high strength at high temperatures, hardness and high specific strength by constituting a structure in which at least quasicrystals are finely dispersed in a matrix composed of aluminum.

In order to solve the above problems, the present invention provides an aluminum-based alloy having high strength and high heat resistance which comprises aluminum as the principal element and at least two transition metal elements added thereto in the range of 0.1 to 25atomic %, said alloy having a structure in which at least quasicrystals are homogeneously dispersed in a matrix composed of aluminum or of a supersaturated aluminum solid solution.

The aforesaid quasicrystals consist of an icosahedral phase (I-phase) alone or a mixed phase of an I-phase and a regular decagonal phase (D-phase).

The above structure is preferably such that the quasicrystals, various intermetallic compounds formed from aluminum and transition metal elements and/or various intermetallic compound formed from transition metal elements are homogeneously and finely dispersed in the matrix composed of aluminum.

Specific examples of preferable compositions of the aluminum-based alloy include (I) one represented by the general formula $Al_{bal}Ni_aX_b$ wherein X is one or two elements selected between Fe and Co; and a and b are, in atomic percentages, $5 \leqq a \leqq 10$ and $0.5 \leqq b \leqq 10$, and (II) one represented by the general formula $Al_{bal}Ni_aX_bM_c$ wherein X is one or two elements selected between Fe and Co; M is at least one element selected from among Cr, Mn, Nb, Mo, Ta and W; and a, b and c are, in atomic percentages, $5 \leqq a \leqq 10$, $0.5 \leqq b \leqq 10$ and $0.1 \leqq c \leqq 5$.

Of the alloys having the composition represented by the above general formulae, an alloy having a structure in which at least one intermetallic compound represented by $Al_{13}Ni$ is dispersed in a matrix composed of aluminum or a supersaturated solid solution of aluminum is more effective in reinforcing the matrix and controlling the growth of crystal grains.

DETAILED DESCRIPTION OF THE PREFERRED EMBODIMENTS

Figure 1:
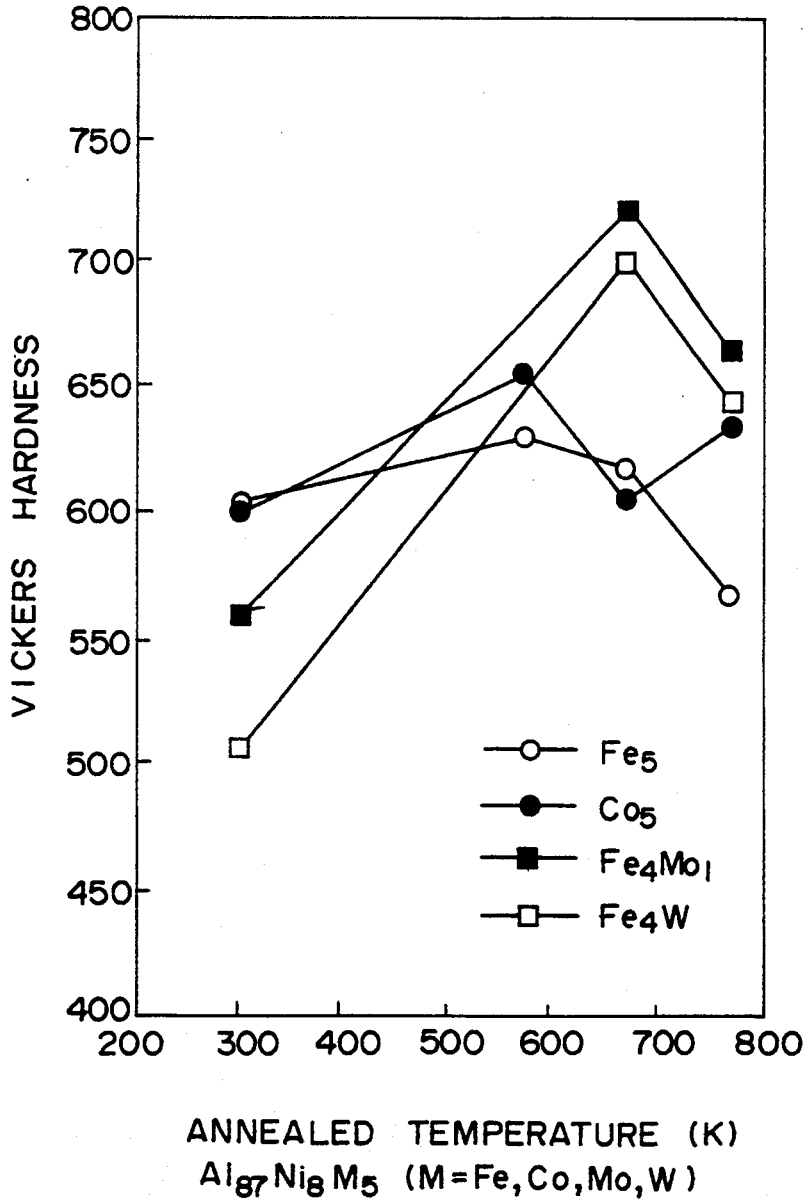
FIG. 1 is a graph showing the relationship between the heat treatment temperature and the hardness of the test pieces in Example 2.

The aluminum-based alloy according to the present invention can be directly produced from a melt of the alloy having any of the aforesaid compositions by single-roller melt-spinning method, twin-roller melt-spinning method, in-rotating water melt-spinning method, any of various atomizing methods, liquid quenching method such as spraying method, sputtering method, mechanical alloying method, mechanical gliding method or the like. In these methods, the cooling rate varies somewhat depending on the alloy composition but is usually $10^2$ to $10^4$ K/sec.

The aluminum-based alloy according to the present invention can possess a structure in which quasicrystals are precipitated from a solid solution by heat treating a rapidly solidified material obtained through the above-mentioned production method or by compacting a rapidly solidified material and thermal working the compact, through extrusion or the like, at a temperature preferably ranging from 360° to 600 ° C.

In the production of the aluminum-based alloy according to the present invention, it is easier of control and more useful than the aforestated direct production method to adopt a method wherein a rapidly solidified material is first produced and, then, heat treated or thermally worked to precipitate quasicrystals.

Now, the reason for limiting the composition of the alloy of the present invention will be described in detail.

In the present invention, quasicrystals can be homogeneously dispersed in an aluminum matrix or a supersaturated solid solution of aluminum by adding at least two transition metal elements in an amount of 0.1 to 25 atomic % to aluminum as the principal element, whereby an aluminum-based alloy excellent in strength, heat resistance and specific strength can be obtained.

The volume fraction of the quasicrystals to be precipitated preferably ranges from 0 to 20% (exclusive of 0). A percentage of 0% cannot achieve the object of the present invention, whereas one exceeding 20% leads to embrittlement of the material, thus making it impossible to sufficiently work the material to be produced.

The total volume fraction of the quasicrystals, various intermetallic compounds formed from aluminum and transition metal elements and/or various intermetallic compounds formed by transition metals preferably ranges from 2 to 40%. In this case, the volume fraction of the quasicrystals to be precipitated preferably ranges from 0 to 20% (exclusive of 0) as in the above case. A percentage less than 2% results in failure to sufficiently enhance the hardness, strength and rigidity of the material to be produced, whereas one exceeding 40% leads to an extreme lowering of the ductility of the material to be produced, thus making it impossible to sufficiently work the material to be produced.

In the present invention, the matrix composed of aluminum or the matrix composed of a supersaturated solid solution of aluminum has preferably an average crystal grain size of 40 to 2000 nm, and the quasicrystals and various intermetallic compounds have each preferably an average particle size of 10 to 1000 nm. An average crystal grain size of the matrix smaller than 40 nm results in an alloy that is insufficient in ductility in spite of its high strength and high hardness, whereas one exceeding 2000 nm leads to a marked decrease in the strength of the alloy to be produced, thus failing to produce an alloy having high strength.

The quasicrystals and various intermetallic compounds each having an average particle size of smaller than 10 nm cannot contribute to the reinforcement of the matrix and cause a fear of embrittlement when made to form excessive solid solution in the matrix, while those each having an average particle size of larger than 1000 nm cannot maintain the strength and function as the reinforcing components because of the excessively large particle size.

Now, specific aluminum-based alloys represented by each of the general formulae will be described in detail.

The atomic % a, b and c are limited to 5 to 10, 0.5 to 10 and 0.1 to 5, respectively, in the general formulae because the atomic % each in the above range can give the alloy higher strength and ductility withstanding practical working even at 300 ° C. or higher as compared with the conventional (marketed) high-strength and heat-resistant aluminum-based alloys.

The Ni element in the aluminum-based alloy as represented by each of the general formulae has a relatively low diffusibility in the Al matrix and ineffective in reinforcing the matrix and suppressing the growth of crystal grains, that is, for markedly enhancing the hardness, strength and rigidity of the alloy, stabilizing the microcrystalline phase and giving heat resistance to the alloy.

The X element(s) is(are) one or two elements selected between Fe and Co, capable of forming a quasicrystal in combination with a Ni element and indispensable for enhancing the heat resistance of the alloy.

The M element is at least one element selected from among Cr, Mn, Nb, Mo, Ta and W, has a low diffusibility in the Al matrix, forms various metastable or stable quasicrystals together with Al and Ni and contributes to the stabilization of the microcrystalline structure and improvement in the characteristics of the alloy at an elevated temperature.

Therefore, the alloy of the present invention can be further improved in Young's modulus, strength at room temperature, strength at an elevated temperature and fatigue strength when it has the composition represented by the general formula.

It is possible to control the aluminum-based alloy of the present invention with regard to crystal grain size, particle sizes of the quasicrystal and intermetallic compounds, amount of the precipitate, dispersion state or the like by selecting proper production conditions of the alloy, and thus produce the objective alloy meeting various requirements such as strength, hardness, ductility, heat resistance, etc., thereby.

Furthermore, excellent properties as the superplastic working material can be given to the alloy by regulating the average crystal grain size of the matrix to be in the range of 40 to 2000 nm.

The present invention will now be described in more detail with reference to the following Examples.

EXAMPLE 1

Each aluminum-based alloy powder having the composition specified in Table 1 was produced by a gas atomizing apparatus, packed in a metallic capsule and degassed to form a billet for extrusion. The billet thus obtained was extruded on an extruder at a temperature of 360° to 600 ° C. The mechanical properties (hardness at room temperature and hardness after holding at 400 ° C. for one hour) of the extruded material (consolidated material) obtained under the aforesaid production conditions were examined. The results are given in Table 1.

TABLE 1

| | Composition (at. %) | | | | Quasi-crystal | Hardness (Hv) | |
|---|---|---|---|---|---|---|---|
| | Al | Ni | X | M | (vol %) | at room temp. | after holding at 400° for 1 hr |
| Example 1 | bal. | 10 | Fe = 0.5 | — | 2 | 390 | 411 |
| Example 2 | bal. | 9 | Co = 1.0 | — | 5 | 370 | 525 |
| Example 3 | bal. | 9 | Fe = 2.0 | — | 7 | 365 | 423 |
| Example 4 | bal. | 8 | Co = 2.5 | — | 8 | 357 | 398 |
| Example 5 | bal. | 8 | Fe = 4.0 | — | 9 | 360 | 421 |
| Example 6 | bal. | 7 | Co = 5.0 | — | 10 | 323 | 509 |
| Example 7 | bal. | 6 | Fe = 1.0, Co = 1.0 | — | 8 | 413 | 456 |
| Example 8 | bal. | 5 | Fe = 2.0, Co = 1.5 | — | 7 | 398 | 365 |
| Example 9 | bal. | 5 | Fe = 2.5, Co = 0.2 | — | 9 | 387 | 368 |
| Example 10 | bal. | 10 | Fe = 0.7 | — | 2 | 389 | 425 |
| Example 11 | bal. | 9 | Co = 1.5 | Cr = 0.2 | 4 | 402 | 526 |
| Example 12 | bal. | 8 | Fe = 1.8 | Mn = 1.0 | 7 | 378 | 365 |
| Example 13 | bal. | 8 | Co = 3.0 | Nb = 2.0 | 15 | 435 | 456 |
| Example 14 | bal. | 7 | Fe = 4.5 | Mo = 3.0 | 13 | 422 | 398 |
| Example 15 | bal. | 6 | Co = 5.0 | Ta = 4.0 | 9 | 412 | 412 |
| Example 16 | bal. | 5 | Fe = 0.5, Co = 1.2 | W = 1.0 | 8 | 488 | 377 |
| Example 17 | bal. | 8 | Fe = 2.2, Co = 1.3 | Cr = 1.0, Mn = 1.2 | 8 | 412 | 456 |
| Example 18 | bal. | 7 | Fe = 1.2, Co = 2.2 | Nb = 3.0 | 9 | 432 | 555 |

TABLE 1-continued

| | Composition (at. %) | | | | Quasi-crystal (vol %) | Hardness (Hv) at room temp. | Hardness (Hv) after holding at 400° for 1 hr |
|---|---|---|---|---|---|---|---|
| | Al | Ni | X | M | | | |
| Example 19 | bal. | 6 | Fe = 1.3, Co = 3.0 | Ta = 2.5 | 7 | 433 | 565 |
| Example 20 | bal. | 5 | Fe = 0.3, Co = 0.2 | Cr = 3.0 | 5 | 478 | 486 |

It can be seen from the results in Table 1 that the alloy (consolidated material) has excellent characteristics in hardness at room temperature and in a hot environment (400° C.) and also has a high specific strength because of its high strength and low specific gravity.

Examinations were made on the elongations at room temperature of each alloy (consolidated material) listed in Table 1 to reveal that it had an elongation not lower than a minimum value (2%) required for usual working.

Test pieces for observation under a transmission electron microscopy (TEM) were cut off from the extruded materials obtained under the above-mentioned production conditions and subjected to observation of the crystal grain size of the matrix and particle sizes of the quasicrystals and intermetallic compounds. In each of the test pieces, the aluminum matrix or the matrix of a supersaturated aluminum solid-solution had an average crystal grain size of 40 to 2000 nm and besides, the particles composed of a stable or metastable phase of the, quasicrystals and the various intermetallic compounds formed from the matrix element and other alloying elements and/or the various intermetallic compounds formed from at least two other alloying elements were homogeneously dispersed in the matrix, and the intermetallic compounds had each an average grain size of 10 to 1000 nm. Also the result of observation under a TEM revealed that the precipitated quasicrystals were composed of an icosahedral phase (I-phase) alone or a mixed phase of an I-phase with a regular decagonal phase (D-phase). In addition, the volume fraction of the precipitated quasicrystals ranged from 0 to 20% (exclusive of 0) and the total volume fraction of the quasicrystals and the intermetallic compounds ranged from 2 to 40%. In particular, $Al_3Ni$ precipitated as an intermetallic compound in the Example.

It is conceivable that in the present Example, the control of the precipitation of the quasicrystals and intermetallic compounds, crystal grain size, particle sizes of the quasicrystals and intermetallic compounds, etc., was effected by thermal working during degassing (inclusive of compacting of powder during degassing) and extrusion.

EXAMPLE 2

Master alloys having compositions by atomic % of (a) $Al_{87}Ni_8Fe_5$, (b) $Al_{87}Ni_8Co_5$, (c) $Al_{87}Ni_8Fe_4Mo_1$ and (d) $Al_{87}Ni_8Fe_4W_1$, respectively, were melted in an arc melting furnace and formed into thin strips with 20 μm thickness and 1.5 mm width by a conventional single-roll liquid quenching apparatus (melt spinning apparatus) having a copper roll with 200 mm diameter at 4,000 rpm in an atmosphere of argon at $10^{-3}$ Torr. The thin strips of alloys having respective compositions as stated above were obtained in the above way, and each of them was examined for the relationship between the hardness of the alloy and heat treatment temperature at a heat treatment time of 1 hour.

The results are given in FIG. 1.

As can be seen from FIG. 1, an alloy exhibiting a high hardness is obtained by the heat treatment at a high temperature (500° to 700 ° C.).

The above-mentioned test pieces of thin strips were observed under a TEM before and after the heat treatment to reveal that the matrix of aluminum or a supersaturated solid solution of aluminum in the thin strips before the heat treatment had an average crystal grain size of Smaller than 400 nm, and some intermetallic compounds having an average particle size of smaller than 10 nm were precipitated. On the other hand, the result of observation of the thin strips after the heat treatment revealed that the aluminum matrix or the matrix of a supersaturated aluminum solid solution had an average crystal grain size of 40 to 2000 nm and besides, the particles composed of a stable or metastable phase of quasicrystals and various intermetallic compounds formed from the matrix element and other alloying elements and/or various intermetallic compounds formed from at least two other alloying elements were homogeneously dispersed in the matrix, and the intermetallic compounds had each an average grain size of 10 to 1000 nm. The volume fraction of the precipitated quasicrystals in each of the samples (a) to (d) was 2% after the heat treatment at 300° C. and 10% after the heat treatment at 700° C. that is increased from 2% to 10% with an increase in the heat treatment temperature from 300° C. to 700° C. However, the percentage remained constant at 10% at the heat treatment temperature exceeding 700° C. The total volume fraction of the quasicrystals and the intermetallic compounds was 2 to 40%. It was seen from the results of observation under a TEM that the quasicrystals and the intermetallic compounds increased with an increase in the heat treatment temperature.

EXAMPLE 3

Figure 2:
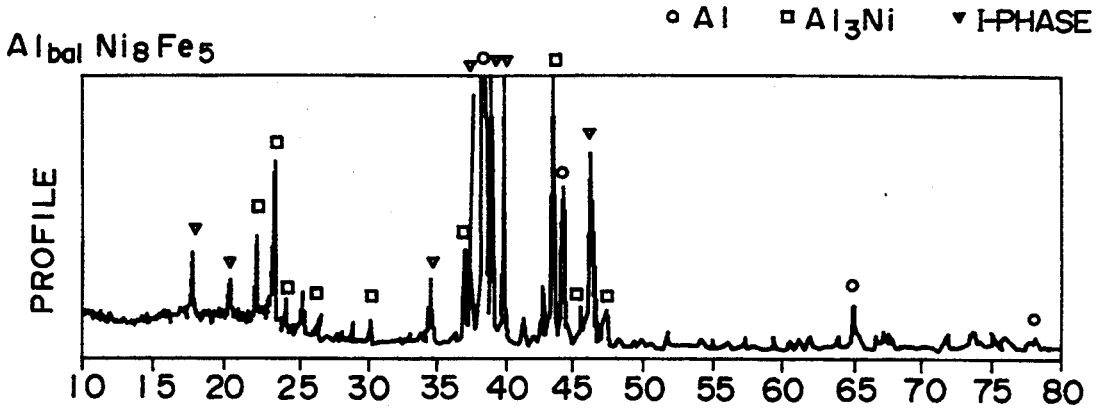
FIG. 2 is a graph showing the result of X-ray diffraction profile of the test piece having the composition consisting of $Al_{bal}Ni_8Fe_5$.
Figure 3:
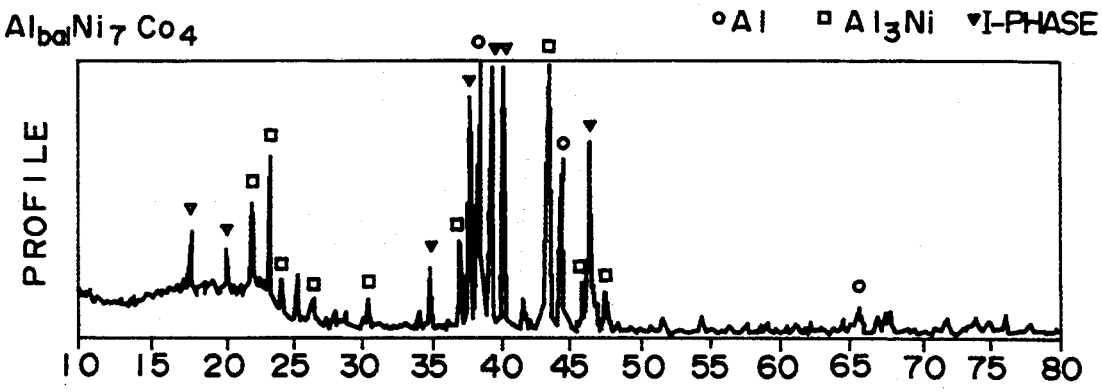
FIG. 3 is a graph showing the result of X-ray diffraction profile of the test piece having the composition consisting of $Al_{bal}Ni_7Co_4$.

In a similar manner to that of Example 2, thin strips having the compositions of $Al_{87}Ni_8Fe_5$ and $Al_{87}Ni_7Co_4$, respectively, were prepared and heat treated at 550° C. for 1 hour to prepare thin strip test pieces, which were subjected to X-ray diffraction profile. The results are given in FIG. 2 and FIG. 3, wherein the peaks as marked with ∘, and □ and ▽ refer to those of Al, $Al_3Ni$ and quasicrystal (I-phase), respectively. It can be seen from FIG. 2 and FIG. 3 that the alloy according to the present invention has a matrix composed of aluminum or a supersaturated aluminum solid solution and quasicrystals and an intermetallic composed consisting of $Al_3Ni$.

In a similar manner to that of Examples 1 and 2, thin strip test pieces were observed under a TEM to reveal that the aluminum matrix or the matrix of a supersaturated aluminum solid solution had an average crystal grain size of 40 to 2000 nm, the quasicrystals (I-phase) and $Al_3Ni$ had each an average particle size of 10 to 1000 nm, the volume fraction of the precipitated I-phase ranged from 0 to 20% (exclusive of 0) and the total volume fraction of the I-phase and $Al_3Ni$ ranged from 2 to 40%.

As described hereinbefore, the alloy according to the present invention is excellent in hardness and strength at room temperature and at high temperature and also in heat resistance and is useful as a material having a high specific strength because of its being constituted of the elements having high strength and low specific gravity.

Being excellent in heat resistance, the alloy according to the present invention can .retain the characteristics obtained through the rapid solidification method, heat treatment or thermal working even when affected by the heat of working.

What is claimed is:

1. An aluminum-based alloy having high strength and heat resistance which consists essentially of aluminum and at least two transition metal elements added thereto in the range of 0.1 to 25 atomic %, said alloy having a structure in which quasicrystals are homogeneously dispersed in a matrix composed of aluminum or a supersaturated solid solution of aluminum, wherein the quasicrystals are dispersed in the matrix in a measurable volume fraction of no more than 20%.

2. The alloy according to claim 1 wherein the quasicrystal is composed of an icosahedral phase (I-phase) alone or a mixed phase of an I-phase and a regular decagonal phase (D-phase).

3. The alloy according to claim 1 wherein the alloy has a composition represented by the general formula: $Al_{bal}Ni_aX_b$, wherein X is one or two elements selected between Fe and Co; a and b are, in atomic percentages, $5 \leqq a \leqq 10$ and $0.5 \leqq b \leqq 10$.

4. The alloy according to claim 1 wherein the alloy has a composition represented by the general formula: $Al_{bal}Ni_aX_bM_c$, wherein X is one or two elements selected from the group consisting of Fe and Co; M is at least one element selected from the group consisting of Cr, Mn, Mo, Ta and W; a, b and c are, in atomic percentages, $5 \leqq a \leqq 10$, $0.5 \leqq b \leqq 10$ and $0.1 \leqq c \leqq 5$.

5. The alloy according claim 1 wherein the alloy is in the form of a rapidly solidified material, a heat treated material of the rapidly solidified material, or a compacted and consolidated material formed from the rapidly solidified material.

6. The alloy according to claim 2 wherein the alloy is in the form of a rapidly solidified material, a heat treated material of the rapidly solidified material, or a compacted and consolidated material formed from the rapidly solidified material.

7. The alloy according to claim 3 wherein the alloy is in the form of a rapidly solidified material, a heat treated material of the rapidly solidified material, or a compacted and consolidated material formed from the rapidly solidified material.

8. The alloy according to claim 4 wherein the alloy is in the form of a rapidly solidified material, a heat treated material of the rapidly solidified material, or a compacted and consolidated material formed from the rapidly solidified material.

9. An aluminum-based alloy having high strength and heat resistance which consists essentially of aluminum and at least two transition metal elements added thereto in the range of 0.1 to 25 atomic %,said alloy having a structure in which quasicrystals and various intermetallic compounds formed from aluminum and transition metal elements and/or various intermetallic compounds formed from transition metal elements are homogeneously and finely dispersed in a matrix composed of aluminum or a supersaturated solid solution of aluminum, wherein the quasicrystals are dispersed in the matrix in a measurable volume fraction of no more than 20%.

10. The alloy according to claim 9 wherein the the alloy is in the form of a rapidly solidified material, a heat treated material of the rapidly solidified material, or a compacted and consolidated material formed from the rapidly solidified material.

11. The alloy according to claim 9, wherein the quasicrystal is composed of an icosahedral phase alone or a mixed phase of an icosahedral phase and a regular decagonal phase.

12. The alloy according to claim 9, wherein the alloy has a composition represented by the general formula: $Al_{bal}Ni_aX_b$, where X is one or two elements selected from the group consisting of Fe and Co, a and b are, in atomic percentages, $5 \leqq a \leqq 10$ and $0.5 \leqq b \leqq 10$.

13. The alloy according to claim 9, wherein the alloy has a composition represented by the general formula: $Al_{bal}Ni_aX_bM_c$, wherein X is one or two elements selected from the group consisting of Fe and Co; M is at least one element selected from the group consisting of Cr, Mn, Nb, Mo, Ta and W; a, b and c are, in atomic percentages, $5 \leqq a \leqq 10$, $0.5 \leqq b \leqq 10$ and $0.1 \leqq 5$.

14. The alloy according to claim 11 wherein the alloy is in the form of a rapidly solidified material, a heat treated material of the rapidly solidified material, or a compacted and consolidated material formed from the rapidly solidified material.

15. The alloy according to claim 12 wherein the alloy is in the form of a rapidly solidified material, a heat treated material of the rapidly solidified material, or a compacted and consolidated material formed from the rapidly solidified material.

16. The alloy according to claim 13 wherein the alloy is in the form of a rapidly solidified material, a heat treated material of the rapidly solidified material, or a compacted and consolidated material formed from the rapidly solidified material.

17. An aluminum-based alloy having high strength and heat resistance which consists essentially of aluminum and at least two transition metal elements added thereto in the range of 0.1 to 25 atomic %, said alloy having a structure in which quasicrystals are homogeneously dispersed in a matrix composed of aluminum or a supersaturated solid solution of aluminum, wherein the alloy is in the form of a rapidly solidified material which has been compacted and consolidated wherein the quasicrystals are dispersed in the matrix in a measurable volume fraction of no more than 20%.

* * * * *

UNITED STATES PATENT AND TRADEMARK OFFICE

CERTIFICATE OF CORRECTION

PATENT NO. : 5,419,789

DATED : May 30, 1995

INVENTOR(S) : Kazuhiko KITA

It is certified that error appears in the above-indentified patent and that said Letters Patent is hereby corrected as shown below:

Claim 9, column 8, line 2, "%,said" should read --%, said--.

Claim 13, column 8, line 32, "$0.1 \leq 5$" should read --$0.1 \leq c \leq 5$--.

Signed and Sealed this

Twenty-fifth Day of June, 1996

Bruce Lehman

*Attest:*

BRUCE LEHMAN

*Attesting Officer*

*Commissioner of Patents and Trademarks*